US007411599B2

(12) United States Patent
Geserich et al.

(10) Patent No.: US 7,411,599 B2
(45) Date of Patent: Aug. 12, 2008

(54) PRINTING MAIL PROCESSING APPARATUS WITH IMPROVED MAILPIECE THROUGHPUT

(75) Inventors: Frank Geserich, Friedrichsthal (DE); Frank Reisinger, Oranienburg (DE)

(73) Assignee: Francotyp-Postalia GmbH (DE)

( * ) Notice: Subject to any disclaimer, the term of this patent is extended or adjusted under 35 U.S.C. 154(b) by 405 days.

(21) Appl. No.: 11/232,396

(22) Filed: Sep. 21, 2005

(65) Prior Publication Data

US 2006/0087549 A1 Apr. 27, 2006

(30) Foreign Application Priority Data

Oct. 1, 2004 (DE) ..... 20 2004 015 279 U

(51) Int. Cl.
*B41J 2/32* (2006.01)

(52) U.S. Cl. ..... 347/171

(58) Field of Classification Search ..... 347/171, 347/187, 191, 215, 104, 11, 4, 2; 400/608.4
See application file for complete search history.

(56) References Cited

U.S. PATENT DOCUMENTS 3,915,089 A 10/1975 Schubert
4,083,555 A 4/1978 Irvine et al.
4,746,234 A 5/1988 Harry
4,767,228 A 8/1988 Harry
4,886,384 A 12/1989 Harry
5,710,721 A 1/1998 Rieckhoff et al.
6,241,235 B1 6/2001 Schmidt-Kretschmer
6,364,306 B1 4/2002 Kunde et al.
6,783,290 B2 * 8/2004 Sussmeier ..... 400/608.4
7,176,954 B2 * 2/2007 Takahashi et al. ..... 347/191
7,264,323 B2 * 9/2007 Tainer et al. ..... 347/11
2004/0021755 A1 2/2004 Sussmeier

* cited by examiner

*Primary Examiner*—K. Feggins
(74) *Attorney, Agent, or Firm*—Schiff Hardin LLP

(57) ABSTRACT

A mail processing apparatus has a field table and a printer disposed above the feed table for printing indicia on a mailpiece moved in a movement direction along the feed table. A start sensor detects a leading edge of the mailpiece and supplies a signal to a microprocessor controller that operates the printer, in order to initiate a printing event on the mailpiece. An ejection roller is disposed following the printer and is operated by a motor to eject the mailpiece from the printer. An end sensor is disposed near the ejection roller and detects a trailing edge of the mailpiece, and supplies a signal to the microprocessor controller that causes the microprocessor controller to disconnect the voltage from the motor that operates the ejection roller.

8 Claims, 3 Drawing Sheets

PRINTING MAIL PROCESSING APPARATUS WITH IMPROVED MAILPIECE THROUGHPUT

BACKGROUND OF THE INVENTION

1. Field of the Invention

The present invention concerns an arrangement for a printing mail processing apparatus according that increases the throughput of mailpieces. The invention can be used in franking machines and in similar printing, accounting or mail processing apparatuses.

2. Description of the Prior Art

U.S. Pat. No. 4,746,234 And East German Patent 233 101 B5 disclose a thermotransfer franking machine having a mailpiece transport path with a start sensor that detects the leading edge of a mailpiece, i.e., the start of a letter envelope, and which is connected with a microprocessor in order to start a printing procedure as soon as a mailpiece arrives in the printing station. A thermotransfer printhead is equipped with a shift register, a memory latch unit and driver unit as well as with a series of thermoprinting heating elements disposed orthogonal to the mailpiece transport direction. The thermotransfer printhead is connected with the serial data output of the microprocessor via a register. The microprocessor controller can advance the ink ribbon corresponding to the transport speed mailpieces by means of signals from an encoder.

U.S. Pat. Nos. 4,767,228, and 4,886,384 and European Application 189 984 disclose an ink ribbon cassette for thermotransfer franking machines with a window for the application of a friction wheel to the ink ribbon and a mailpiece transport device as is used in similar form in modern thermotransfer franking machines of the type T1000 and Optimal® of Francotyp-Postalia. When a flap for the cassette bay is opened, a simple mechanism is actuated and the friction wheel is moved away from the ink ribbon of the cassette, allowing the cassette to be removed.

U.S. Pat. No. 5,710,721 and European Application 716 398 disclose an internal franking machine circuit connected with a first microprocessor controller circuit that is the same for all franking machines. The internal franking machine circuit allows the connection of a variable number of sensors and actuators corresponding in type and number to the franking machine type. An adaptation to different printing methods is enabled by the use of different application-specific circuits (ASICs). Production piece numbers for franking machines of the same type, however, in order to justify the cost of the mask programming of the ASICs.

In thermotransfer franking machines of the type T1000 and Optimal®, an encoder disc is fastened on the same axle as a friction wheel and is consequently likewise rotated corresponding to the rotation of the encoder wheel when the ink ribbon is advanced. The operation of the machine is interrupted if an ink ribbon transport does not occur or after the passage of a predetermined time after a franking. This is also called the ejection phase. Up to 25 mailpieces with a maximum thickness of 5 mm can be franked per minute. When the franking event has ended, the microprocessor of the franking machine can check, by means of the start sensor whether the mailpiece (for example the letter envelope) has been transported into the printing region. The start sensor is positioned on the leading edge of the transport path, and the microprocessor thus can detect whether the letter envelope is still lying on the leading edge. It can occur that, due to rotation of the letter envelope, during the franking the letter envelope no longer actuates the start sensor, so the letter envelope is no longer detected during and after the franking. The microprocessor thus can no longer definitely detect with the start sensor whether the letter envelope has already exited the franking machine. If the ejection event were ended due to the interrogation of this start sensor, the letter envelope could remain in the franking machine or could repeatedly trigger the start sensor if it executes an unusual movement, for example with the trailing edge of the letter envelope. This has conventionally been addressed by an (in principle) long ejection phase (without interrogation of the start sensor), but this leads to a lower mailpiece throughput of the franking machine.

The use of additional sensors in order to increase the throughput of mailpieces is known from United States Patent Application Publication No. 2004/0021755, in which mailpieces are transported faster before and after the printing.

SUMMARY OF THE INVENTION

An object of the present invention is to provide a sensor in a printing mailpiece processing apparatus and to connect it with the controller so that the throughput of mailpieces of different lengths can be increased. An internal interface circuit connected with the microprocessor controller should also be achieved more cost-effectively with an increased number of sensors/actuators.

The above object is achieved in accordance with the present invention in a mail processing apparatus having a printer operated by a microprocessor controller to execute a printing event on a mailpiece that is moved, such as by motorized movement, on a feed table past the printer. The apparatus has a start sensor that detects a leading edge of the mailpiece, during the feed of the mailpiece, and emits a signal to the microprocessor controller causing the microprocessor controller to initiate the printing event. The apparatus has a motor-operated ejection roller disposed following the printer that interacts with the mailpiece to eject the mailpiece from the printer. The apparatus has an end sensor disposed near the ejection roller that detects the end (trailing edge) of the mailpiece and emits a signal to the microprocessor controller causing the microprocessor controller to disconnect voltage from the motor that operates the ejection roller.

In printing mail processing apparatuses, the mailpieces are transported relative to the printhead. For establishing the duration of the ejection phase of the printing mailpiece processing apparatus, the mailpiece with the largest dimensions (for example a letter envelope length of the format B4) conventionally had to be taken into account. Starting from the goal to shorten the ejection phase, to allow the printing mailpiece processing apparatus to be more quickly ready after a printing, to print a subsequent letter envelope, the invention makes use of a (letter envelope) end sensor that can detect when the mailpiece (letter envelope) has actually exited the printing mail processing apparatus. The ejection phase is ended after this detection and the (letter envelope) start sensor can be interrogated again. The length of the ejection phase thus is dependent on the letter envelope length, and the next letter envelope can already be detected earlier in order to start printing of the following letter envelope earlier, in the event that the length of the present letter envelope is not maximum.

The end sensor is positioned in the region of the ejection roller of the printing mail processing apparatus, and a circuit for interrogation of the end of a mailpiece by means of an end sensor has an electrical connection of the end sensor, via a special, programmable printing controller component, with the microprocessor controller. For such a special, programmable printer controller component, the cost of the mask programming of an ASIC are justifiable given higher piece counts at the printing mail processing apparatus. For small piece counts at the printing mail processing apparatus, however. that is not profitable. Therefore a different programmable logic that is universally spatially and temporally effective is used. While the spatially-effective programming (for example field programming) establishes the inner structure of the logic, the process and the order of the data processing of logic gates within the logic are defined by the temporally-effective programming. The invention is explained herein in an example of a franking machine, but it is not limited to this use alone.

DESCRIPTION OF THE PREFERRED EMBODIMENTS

Figure 1:
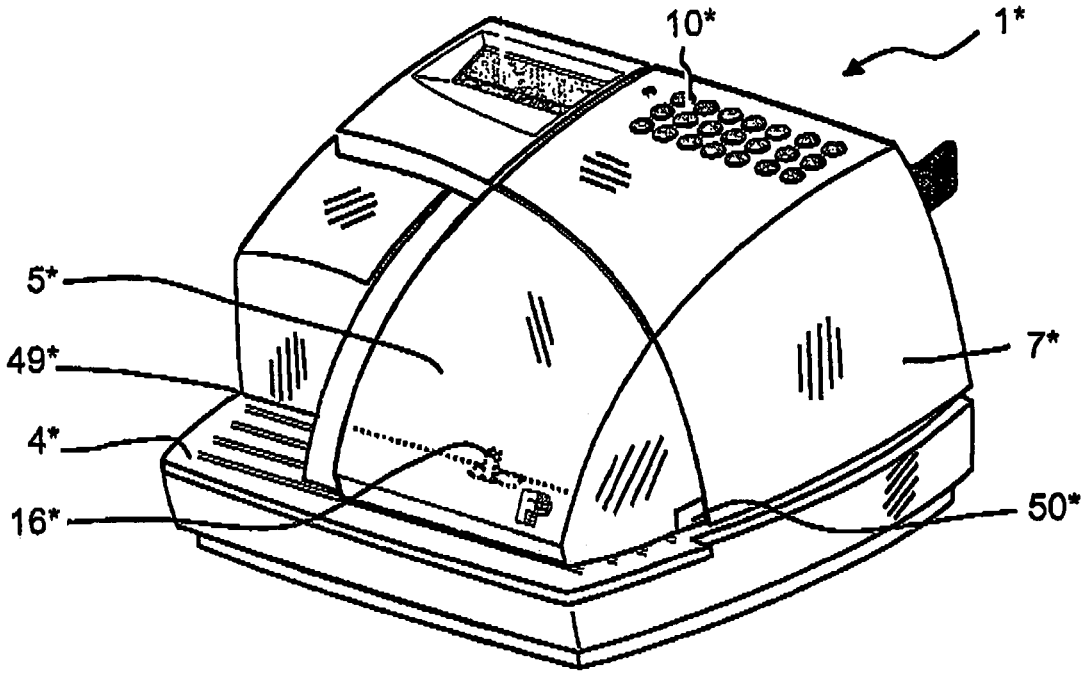
FIG. 1 is a perspective view of a known thermotransfer franking machine, showing with the flap of the cassette bay.

FIG. 1 shows a perspective view of a known thermotransfer franking machine 1* from the front and upper right. The thermotransfer franking machine 1* of the type Optimail® has a start sensor 16* (indicated dashed since it is covered) underneath a cassette bay in the feed table 4*. The start sensor 16* supplied a signal to a microprocessor, but from this signal the microprocessor cannot definitively detect whether the letter envelope has already exited the franking machine. The franking machine is equipped on its right side 7* and on its upper part 10* with a flap 5* for the cassette bay of the franking machine 1*. The flap 5* has an activation field 50* at its opening. The transport of a mailpiece to and from the franking machine 1* ensues on the feed table 4* on the transport edge 49* on the front side of the franking machine 1*, from left to right.

Figure 2:
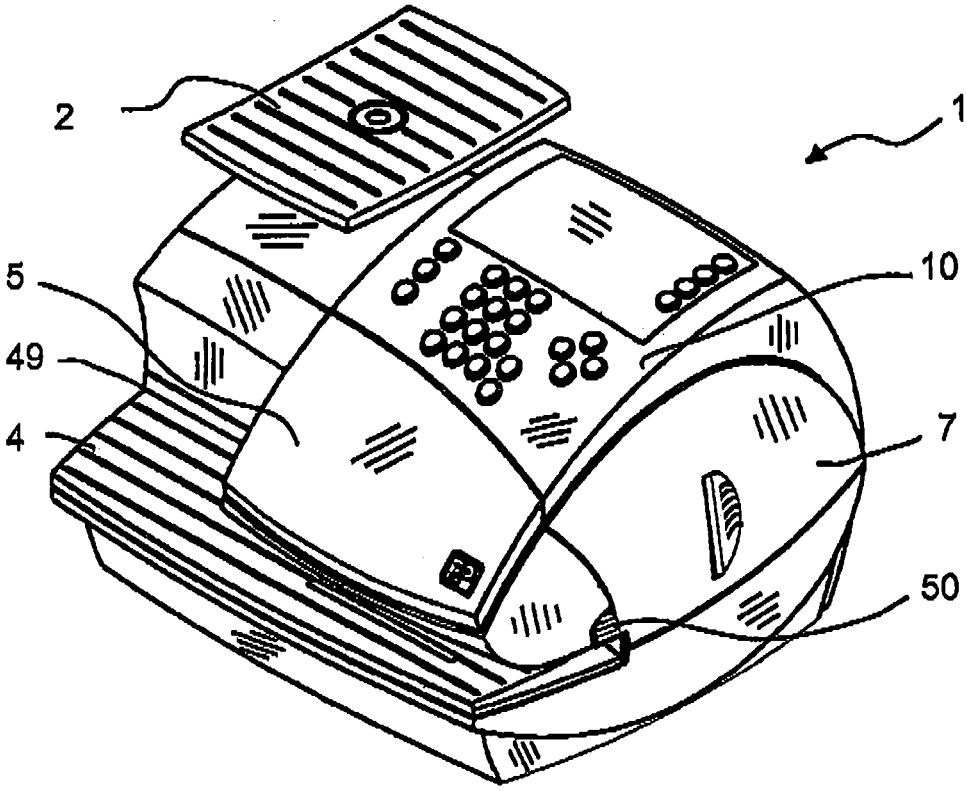
FIG. 2 is a perspective view from the front and upper right of a thermotransfer franking machine of the next generation.

FIG. 2 shows a perspective view from the front and upper right of a thermotransfer franking machine 1 of the next generation. The thermotransfer franking machine 1 is equipped on its right side 7 and on its upper part 10 with a flap 5 for the cassette bay of the franking machine 1 and on its left side with a weighing plate 2 of a scale component. The flap 5 has an activation field 50 at its opening. All housing parts are manufactured, for example, of colored plastic. The transport of a mailpiece to and from the franking machine 1 ensues on the feed table 4 of the franking machine on the front side of the franking machine 1, from left to right.

Figure 3:
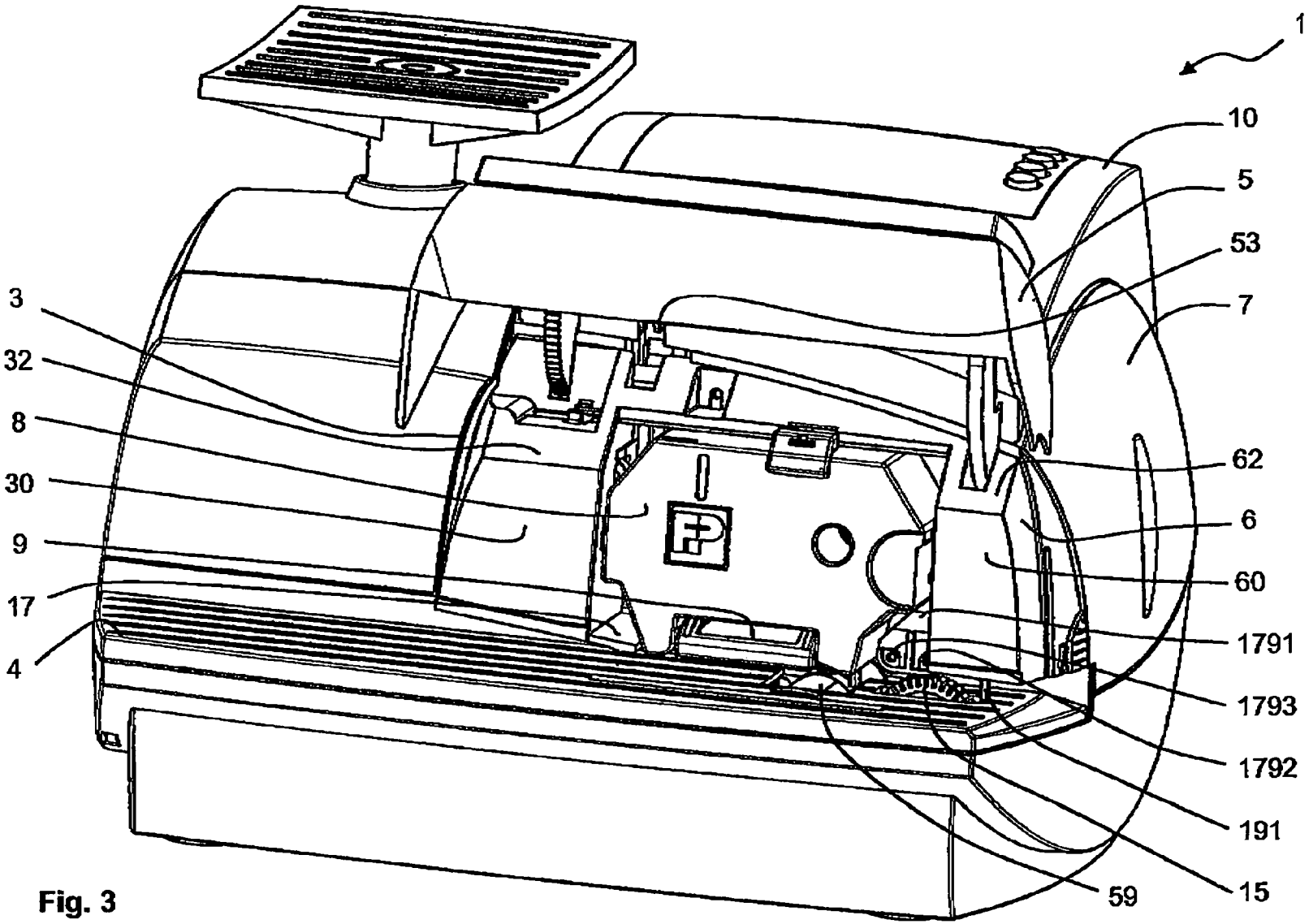
FIG. 3 is a perspective view of the thermotransfer franking machine with opened cassette flap.

FIG. 3 shows a perspective view from the front and upper right of a thermotransfer franking machine 1 with an opened flap 5. The flap 5 is shown opened in the direction toward the upper part 10. The flap 5 has flap arms at both sides on its underside. On one side, the right external housing wall 6 on the cassette bay merges on the right side 7 into the right side wall of the upper shell of the franking machine and, on the other side, into the right cover 60. Upwardly directed steps 62 are provided that correspond to the flap shape on its underside. On the other side, the left external housing wall 3 on the cassette bay merges into the upper shell of the franking machine and, on the other side, into the left cover 30, further upwardly directed steps 32 are provided that correspond to the flap shape on its underside. Upon closing of the flap, the arms of the cassette flap 5 project into a corresponding slot-shaped opening in the steps 32 and 62 of the left cover 30 and the right cover 60, respectively. On its underside, the flap 5 moreover has a flap finger 53 serving as an actuator for a mechanism that detects the position of the flap by means of a sensor (not visible). The travel of the flap during opening thereof is designed so that sufficient time is provided for deactivation of the supply voltage 14 (see FIG. 4) for a chip reader unit before extraction of the ink ribbon cassette 8 is possible.

Figure 4:
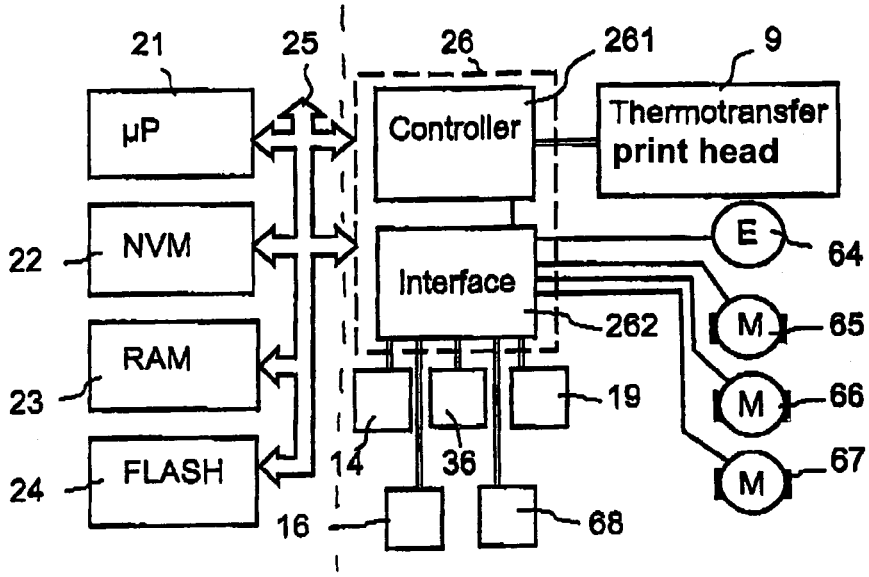
FIG. 4 is a block diagram for the controller of a thermotransfer printer with an end sensor for interrogation of the end of a mailpiece, in accordance with the present invention.

FIG. 4 shows a block diagram for control of a thermotransfer printing with end sensor for interrogation of the end of a mailpiece. A microprocessor 21 is connected, in terms of addresses, data and control, with at least one non-volatile memory 22, a pixel memory RAM 23, a fixed value memory FLASH 24 as well as with a printer controller component 28, via a bus 25. An encoder 64 is connected with the print data controller 261 of the component 26 in order to synchronously initiate the buffering of the binary pixel data and the printing of the print image gaps. For data input/output, an interface controller 262 of the component 26 is connected with the chip reader unit 14, and with a motor 65 for actuation of a conveying device for mailpieces in the transport direction. The interface controller 262 also is connected to a motor 66 for actuation of an axle for a take-up reel of the ink ribbon cassette; and with a motor 67 for actuation of an activation device for a counterpressure roller. The interface controller 262 also is connected on the other side with sensors, such as the start sensor 16, end sensor 19, an activation sensor 36 for detection of the flap position/encoder position and an activation sensor 68 of the activation device. A printing procedure is started and a franking is executed when a leading edge of a mailpiece is detected by the start sensor 16. The end sensor 19 is disposed downstream (in terms of mail flow) at a distance from the start sensor 16 and detects the successive passage of the leading edge and then the trailing edge of a transported mailpiece. Corresponding sensor signals arrive at the microprocessor of the microprocessor controller 20 which disconnects a motor operation voltage of the motor 65 by means of the printing controller component 26, the motor 65 serving both for actuation of the conveyance device for mailpieces in the transport direction and for actuation of the ejection roller 15. Moreover, a motor operating voltage of the motor 66 for actuation of the take-up reel axle is disconnected.

A thermotransfer printhead 9 is equipped in a known manner with a register, a memory latch unit and driver unit as well as with a series of thermotransfer printing heating elements disposed orthogonal to the mailpiece transport direction. The thermotransfer printhead 9 is connected via the register with the serial data output of the print data controller 261 which, given a direct memory access, on the input side, receives 16-bit parallel binary print image data from the bus 25 and, on the output side, emits serial binary print image data.

The encoder 3 is connected with the print data controller 261 (if applicable via the interface controller 262) in order to synchronously initiate the buffering of the binary pixel data and the printing of the print image gaps, whereby the printhead 9 is activated with a clock frequency that allows a transport speed of approximately 150 mm per second for mailpieces up to 6 mm thick.

The primary control circuit board of a franking machine moreover has further interfaces (not shown), for example for connection of a keyboard and a display unit, a chip card write/read unit, a modem as well as, if applicable, a security module (which is also designated as a PSD (Postal Security Device)). However, the PSD can be omitted for pure printing tasks.

The printer controller component 25 can be realized either as an application-specific circuit (ASIC) or by programmable logic such as, for example, the field programmable gate array (FPGA) chip component of the series Spartan-II 2.5V by the company XILINX (www.xilinx.com). A use of the FPGA allows the costs of the mask programming of the ASICs to be spared.

An FPGA is an integrated circuit that contains many thousands of identical logic cells as standard components (up to 50,000 in the XC2S50 by the company XILINX). Each logic cell can independently adopt any of a limited set of properties. The individual cells are interconnected by a matrix of the conductors and the programmable switch. The design needed by a specific user is introduced by the simple logic function for each cell being specified and the switch selectively locks in the linkage matrix. Complicated designs are facilitated by these fundamental blocks being combined in order to create the desired circuit. These blocks form field-programmable means that have the advantageous function of being defined by a program of the user instead of by the manufacturer of the device. The program is either burned-in permanently or semi-permanently as a part of the board configuration process, or is loaded from an external memory at each time when the aforementioned printing device is activated. The configuration data for the FPGA XC2S50 encompass approximately 0.6 Gbit and are stored in the fixed value memory FLASH 24 (FIG. 4). The use of an FPGA chip and technologies associated therewith offer the advantage that the programmable logic saves development costs and time relative to an ASIC design that is complicated to an increasing degree and the grid count per FPGA chip has now reached counts that allow the implementation of ever more complicated applications. This allows a large degree of programmer freedom in hardware and software, whereby CAD tools decide which parts of a source code program should be executed as software and which parts should be executed as hardware.

Furthermore, the circuit arrangement of the component 26 can be realized by means of conventional technology, i.e. as a hard-wired circuit of logic gates of positive and/or negative logic.

Figure 5:
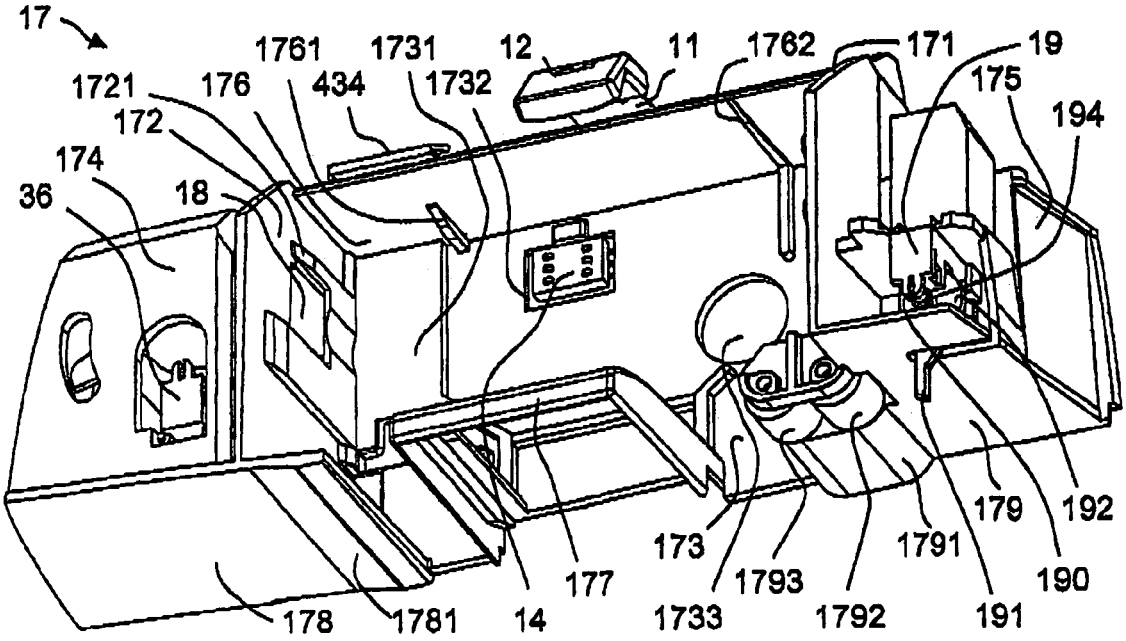
FIG. 5 is a perspective view of the shaped cassette bay part from the front and lower right.

FIG. 5 shows the perspective view of a shaped cassette bay part from the front and lower right. A respective mechanism located under the cover and gradations of the upper housing shell rests (in a manner not shown) on the chassis between the left inner housing wall 172 and the right inner housing wall 171 and the left and the right external housing wall on the shaped cassette bay part 17, while associated sensors are supported on respective integrally-molded sensor carriers 174 and 175. The sensor 36 for detection of the cassette flap position/encoder position is supported on the sensor carrier 174 (externally, integrally-molded on the left inner housing wall 172) of the shaped cassette bay part 17. The inner chamber (cassette bay) of the shaped cassette bay part 17 is bordered by the right inner housing wall 171, the left inner housing wall 172 and the rear housing wall 173. A molding 1731 on the edge between the left inner housing wall 172 an the inside of the rear housing wall 173 forms an outer wall of a channel for a slider, of which only its top slope 434 is visible. A quadrilateral opening 1732 in the rear housing wall 173 accommodates the chip reader unit 14. A circular opening 1733 in the rear housing wall 173 is provided for the winding mandrel (not shown) of the cassette coil. The left inner housing wall 172 has an opening 18 and a lateral guide 1721 for correct positioning of the cassette upon insertion. The right inner housing wall 171 likewise has a lateral guide. An upper housing wall 176 likewise has guides 1761, 1762 as a positioning aid. The upper housing wall 176 merges laterally into the left and right inner housing walls and to the rear into the rear housing wall 173, and not only stabilizes the cassette bay, but also has integrally-molded fasteners (covered) for a spring-biased locking element 11, at the free end of which a pressure element 12 is integrally molded. A frame 177 for the printhead 9, which frame 177 protrudes into the inner space of the cassette bay, is integrally molded on the lower end of the rear housing wall 173 in its center. The space formed by the lateral integrally-molded sensor carriers 174 and 175 is sealed at the bottom by a base plates 178, 179 that are each integrally-molded on the rear housing wall 173 between the left and right inner housing walls 172 and 171. For low-friction mailpiece transport, it is advantageous for the base plate 178 to gently ascend relative to the feed table and ends (downstream in terms of the mail flow) in a thickened edge 1781 before the frame 177 for the printhead. Furthermore, for the ejection of the mailpieces it is advantageous for the base plate 179 to begin after the frame 177 with a thickening 1791 which accommodates and bears un-driven rollers 1792 and 1793 such that they can rotate.

The end sensor 19 here rests on the sensor carrier 175 integrally-molded on the right on the shaped cassette bay part 17. The activation element of the end sensor 19 is fashioned as a sensor actuation lever 191 that is arranged on a rotation axle 190 of the end sensor 19 such that it can move in a rotary fashion counter to an elastic force and is connected with a leg of a torsion sprint 194. In the mounted state, the trigger end of the sensor actuation lever 191 lies next to or at the end of the ejection roller 15. Opposite the trigger end of the sensor actuation levelr 191, the sensor actuation lever 191 passes into a disc 192 which is scanned by a sensor electronic. The sensor electronic is housed in the sensor electronic housing 193. For example, a sensor of the type Photointerrupter LG-413L by the company Kodenshi Corp. can be used.

As an alternative to the arrangement on the lateral integrally-molded sensor carrier 175 of the shaped cassette bay part of the upper housing shell, the end sensor 19 can be arranged in the lower housing shell below an opening in the feed table. In that case it has a sensor actuation lever 191 shaped so that its trigger end is positioned in the region of the ejection roller 15. The trigger end preferably extends to near the ejection roller 15 or at the end thereof.

The sensor actuation element can be a spring-biased, rotatable sensor actuation lever 191. Instead of this other implementations are also conceivable as a sensor actuation element in order to detect a movement. The torsion spring 194, if applicable, can be omitted.

The microprocessor controller 20 is connected with the motor 65 for actuation of a transport device for mailpieces as well as with the further motors 66, 67 of the mail processing apparatus via a controller in the programmable printer controller component 26. Given a controller equipped with a field-programmable printer controller component, in principle an adaptation to any mail machine types with different numbers of sensors and actuators and motors is economically possible, even given small piece counts.

Although modifications and changes may be suggested by those skilled in the art, it is the intention of the inventors to embody within the patent warranted hereon all changes and modifications as reasonably and properly come within the scope of their contribution to the art.

We claim as our invention:

1. A mail processing apparatus comprising:

a feed table adapted to allow movement of a mailpiece along the feed table in a movement direction;

a thermotransfer printer disposed above said feed table;

a microprocessor controller for controlling a printing event by said thermotransfer printer wherein the printer prints indicia on the mailpiece;

a start sensor disposed preceding said printer in said movement direction, said start sensor detecting a leading edge of the mailpiece and emitting a signal to the microprocessor controller that initiates the printing event;

an ejection roller, operated by a motor supplied with a voltage, disposed following said printer in said movement direction, to interact with the mailpiece to eject said mailpiece from said thermotransfer printer; and an end sensor disposed near said ejection roller to detect a trailing edge of said mailpiece and to emit a signal to said microprocessor controller that causes said microprocessor controller to disconnect said voltage from said motor.

2. An apparatus as claimed in claim 1 comprising a housing having a cassette bay with a thermotransfer ribbon cassette disposed therein, said cassette bay comprising a cassette bay part with a sensor carrier integrally molded thereon, said sensor carrier supporting said end sensor at a position to detect said trailing edge of said mailpiece.

3. An apparatus as claimed in claim 2 wherein said end sensor comprises a spring-biased pivotable sensor actuation lever disposed to interact with said mailpiece to detect said trailing edge thereof.

4. An apparatus as claimed in claim 1 wherein said feed table has an opening therein, and wherein said end sensor comprises a sensor actuation lever projecting through said opening to interact with said mailpiece to detect said trailing edge.

5. An apparatus as claimed in claim 1 comprising a transport device for moving said mailpiece along said feed table in said movement direction, and a programmable printer controller, said programmable printer controller being connected to said microprocessor controller, and said programmable printer controller being connected to said transport device, said start sensor and said end sensor being connected to said programmable printer controller and supplying said respective signals to said microprocessor controller via said programmable printer controller, and said microprocessor controller controlling said transport device via said programmable printer controller.

6. An apparatus as claimed in claim 5 wherein said programmable printer controller is a field-programmable component.

7. An apparatus as claimed in claim 5 wherein said programmable printer controller is an application-specific integrated circuit.

8. An apparatus as claimed in claim 1 wherein said programmable printer controller comprises an internal interface controller connected to at least one of said start sensor and said end sensor, and wherein said at least one of said start sensor and said end sensor supplies the respective signal therefrom to said microprocessor controller via said internal interface controller.

* * * * *